United States Patent [19]

Hiraku et al.

[11] 4,394,636

[45] Jul. 19, 1983

[54] STRUCTURE OF A TRANSFORMER

[75] Inventors: Imaizumi Hiraku, Shisui; Mitsui Tadashi, Tokyo, both of Japan

[73] Assignee: TDK Electronics Co., Ltd., Tokyo, Japan

[21] Appl. No.: 259,704

[22] Filed: May 1, 1981

[30] Foreign Application Priority Data

May 8, 1980 [JP] Japan ..... 55-63047[U]

[51] Int. Cl.[3] ..... H01F 27/26; H01F 27/30

[52] U.S. Cl. ..... 336/172; 336/210; 336/212

[58] Field of Search ..... 336/172, 212, 214, 215, 336/233, 221; 323/331, 250

[56] References Cited

U.S. PATENT DOCUMENTS

| | | | |
|---|---|---|---|
| 3,007,125 | 10/1961 | Furbee | 336/212 X |
| 3,173,119 | 3/1965 | Thompson | 336/212 X |
| 4,004,251 | 1/1977 | Hesler et al. | 336/212 X |

*Primary Examiner*—Thomas J. Kozma

*Attorney, Agent, or Firm*—Robert T. Gammons

[57] ABSTRACT

A transformer having a main winding and a control winding has a pair of E-shaped cores (10, 11), and an I-shaped third core (13) positioned on one E-shaped core (10). A small groove (14) is provided on the base plate (10*c*) of the first E-shaped core (10). A control winding (12) is wound on the I-shaped core (13) so that the winding (2) rests in the groove 14. Those cores (10, 11, 13) are made of ferrite material. Thus, both the main winding and the control winding can be produced using a winding machine.

4 Claims, 6 Drawing Figures

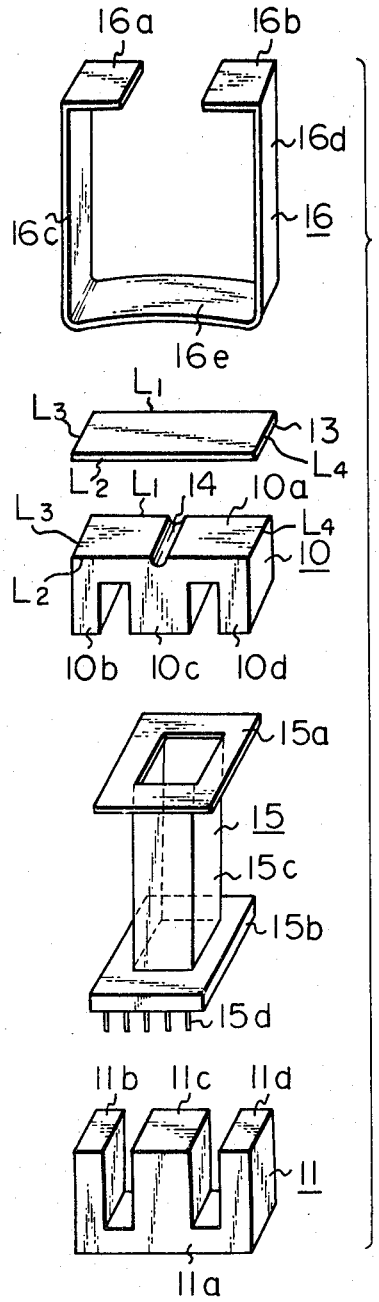
Fig. 3B
Fig. 3C
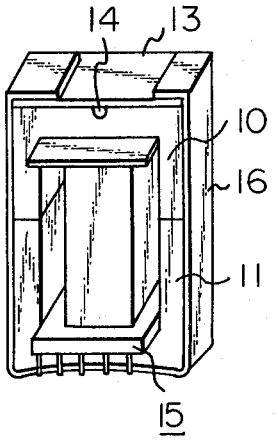

STRUCTURE OF A TRANSFORMER

BACKGROUND OF THE INVENTION

The present invention relates to an improved structure of a transformer having improved core assembly structure.

The core of the present transformer has two magnetic paths with windings (a main winding and a control winding), and can be utilized as a firing transformer for a gas discharge lamp or a variable inductance element. The Japanese patent laid open publication 10221/80, which has the convention priority based upon the U.S. patent application Ser. No. 969381, shows the use of that kind of transformer for a gas discharge lamp. Further, the present transformer can be used as a variable inductance element which is utilized for a tank circuit (resonator) in a wireless radio set or a television set for tuning purposes. When the transformer is utilized for a firing transformer of a gas discharge lamp, the two magnetic paths may either be dependent upon each other, or independent from each other. When two magnetic paths are independent from each other, the present transformer is substantially the same as two separate transformers having a control winding on a closed first core, and a main winding on the other core.

A prior core for this kind of transformer is shown in FIGS. 1 and 2, in which the reference numeral 1 shows the laminated silicon steel plates which are E shaped, and 3 is a small window provided on one side of the plates. A pair of E-shaped plates align to produce a substantially 8-shaped plate as shown in FIG. 1, and the lamination of the 8-shaped plates provides the main magnetic path for the transformer. The main winding 4 is wound on the center leg of said 8-shaped core, and the control winding 2 is wound through the window 3.

In the above structure, the main windings 4 can be wound using a winding machine on a bobbin (not shown). After the main winding 4 is wound on a bobbin, a pair of E-shaped cores are inserted in the bobbin to provide a closed magnetic path. But, a control winding 2 must be wound manually through the window 3. Due to the manual winding operation, it takes a long time to produce a transformer, and very often, a coil to be wound is subject to damage in the manual winding process.

SUMMARY OF THE INVENTION

It is an object, therefore, of the present invention to overcome the disadvantages and limitations of a prior transformer with a small window by providing a new and improved transformer.

It is also an object of the present invention to provide a transformer with main windings and control windings through a small hole of the core, in which both the main windings and the control windings may be produced using a winding machine.

The above and other objects are attained by a transformer comprising of at least a pair of E-shaped cores (10, 11) each having a base plate (10*a*, 11*a*), a center leg (10*c*, 11*c*) extending perpendicularly from the center of said base plate (10*a*, 11*a*), a pair of side legs (10*b*, 10*d*; 11*b*, 11*d*) extending perpendicularly at the ends of the base plate (10*a*, 11*a*); a small window (3) provided at the center of the base plate (10*a*) of at least one of said E-shaped cores (10, 11), a bobbin (15) provided on the center legs (10*c*, 11*c*) of said two E-shaped cores (10, 11); a main coil wound on said bobbin; a control coil wound through said window (3), each of said E-shaped cores (10, 11) being integral and being made of ferrite material; a further rectangular I-shaped core (13) having a pair of long sides and a pair of short sides being provided on the base plate (10*a*) of one E-shaped core (10); an elongated groove (14, 20) being provided between said I-shaped core (13) and the base plate (10*a*) at the center of said I-shaped core (13) so that the groove (14, 20) being parallel to the short sides of the I-shaped core (13), and said groove (14, 20) providing as said window (3); said control coil being wound on said I-shaped core (13) so that the control coil being accepted in the groove (14, 20); and a resilient clamp means (16) for clamping said I-shaped core (13), and a pair of E-shaped cores (10, 11).

BRIEF DESCRIPTION OF THE DRAWINGS

The foregoing and other objects, features, and attendant advantages of the present invention will be appreciated as the same become better understood by means of the following description and accompanying drawings wherein;

FIG. 3B is the disassembled view of the transformer of FIG. 3A, FIG. 3C is the assembled view of the transformer of FIG. 3A.

DESCRIPTION OF THE PREFERRED EMBODIMENTS

Figure 1:
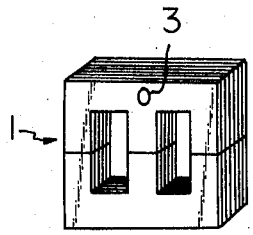
FIG. 1 shows the structure of the core utilized in a prior transformer.
Figure 2:
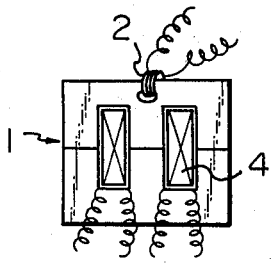
FIG. 2 shows the structure of a prior transformer utilizing the core of FIG. 1.
Figure 3A:
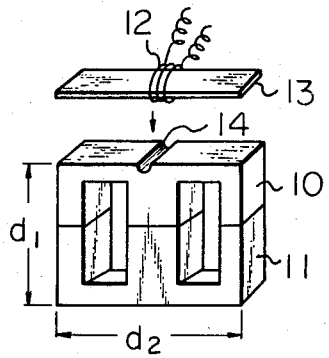
FIG. 3A shows the structure of the transformer according to the present invention.

The first embodiment of the present invention is shown in FIGS. 3A, 3B and 3C. In those figures, the reference numerals 10 and 11 show the first and the second E-shaped ferrite cores, 12 is a control winding, 13 is an I-shaped ferrite core, 14 is an elongated groove provided at the top of the first E-shaped core 10, 15 is a dielectric bobbin, and 16 is a resilient clamp. The cores 10, 11, and 13 are made of ferrite material, each of which is integral but are not laminated. The first E-shaped core 10 has the base plate 10*a*, the pair of side legs 10*b* and 10*d* perpendicularly extending from the ends of said base plate 10*a*, and the center leg 10*c* perpendicularly extending from the center of the base plate 10*a*. Those legs 10*b*, 10*c*, 10*d* are parallel with one another, and are equal in length with one another. Between those legs, a pair of empty spaces are provided for accepting a main coil (not shown). The base plate 10*a* is rectangular having a pair of long sides ($L_1$, $L_2$) and a pair of short sides ($L_3$, $L_4$). An elongated groove 14 is provided on the base plate 10*a* as shown in FIGS. 3A and 3B. That groove 14 is parallel to the short sides ($L_3$, $L_4$) of the base plate 10*a*, and is provided at the center between those short sides. The length of that groove 14 is the same as the length of the short sides. Preferably, the cross section of the groove 14 is half-circular.

The second E-shaped core 11 has the same structure as that of the first E-shaped core 10, except that the second core 11 does not have a groove in the embodiment. It should be appreciated, however, that the structure having a groove is available for the second E-shaped core 11. The second E-shaped core 11 has the base plate 11*a*, the pair of side legs 11*b* and 11*d*, and the center leg 11*c*.

The bobbin 15 is made of dielectric material, having the hollow rectangular center leg 15*c*, and a pair of flanges 15*a* and 15*b* at the ends of the center leg 15*c*. The bottom flange 15*d* has a plurality of connector pins 15*d* for effecting the coupling of the present transformer with an external circuit.

The I-shaped rectangular ferrite core 13 is also integral, but is not laminated, and the long length ($L_1$, $L_2$) and the short length ($L_3$, $L_4$) of the I-shaped core 13 are substantially the same as those of the base plate 10*a* of the E-shaped core 10.

The clamp 16 is made of resilient material for fixing the cores 10,11 and 13 with spring force, and is substantially U-shaped as shown in FIG. 3B. The clamp 16 has a pair of projections 16*a* and 16*b*, a pair of straight legs 16*c* and 16*d*, and a base portion 16*e*. The base portion 16*e* is slightly inwardly curved as shown in FIG. 3B so that said curved portion and the pair of projections can fix the cores using spring force.

A main coil (not shown) is wound on the bobbin 15, and a control coil 12 is wound on the I-shaped core 13. Those coils are wound using a winding machine.

When the coils are wound, the pair of E-shaped cores 10 and 11 enclose the bobbin 15 so that the corresponding legs 10*b* and 11*b*, 10*c* and 11*c*, and 10*d* and 11*d* abut with each other, respectively. Then, the I-shaped core 13 with the control winding 12 is placed on the first E-shaped core 10 so that the control coil 12 is received in the groove 14. Then, the clamp 16 fixes the cores 10, 11 and 13 together. The lead wires of the coils are soldered to the connector pins 15*d*. The structure of the assembled structure of the present transformer is shown in FIG. 3C.

In the above description, it should be appreciated that a control winding can be wound using a winding machine, since the cores relating to that control winding are separated to the first E-shaped core 10 and the I-shaped core 13. Although the cores 10 and 13 are separated, the magnetic reluctance relating to those cores is small, since the cores 13 contacts with the core 10 with a considerably wide area, and the magnetic flux circulating the control coil 12 is not disturbed by the separation of the cores 10 and 13.

Figure 4:
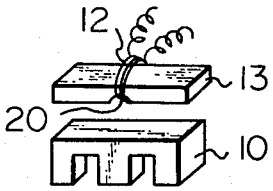
FIG. 4 shows the structure of another embodiment of the transformer according to the present invention.

FIG. 4 shows another embodiment of the present invention, in which no groove is provided on the E-shaped cores 10 and 11, and instead, a groove 20 is provided on the I-shaped core 13, so that the groove 20 is parallel to the short sides of the I-shaped core 13, and is provided at the center of the core 13. The structure of FIG. 4 has the advantage that the control coil 12 is positioned exactly on the core 13 during the winding operation because of the presence of the groove 20 on the I-shaped core 13.

Some modifications of the present transformer are possible to those skilled in the art. For instance, a pair of E-shaped cores 10 and 11 can be replaced by the combination of an E-shaped core and an I-shaped core. In that case, the three legs of the E-shaped core must be doubled as compared with the legs of the embodiment of FIG. 3 or FIG. 4, and the I-shaped core corresponds to the base plate 11*a* of the second E-shaped core 11 of the previous embodiments.

When the present transformer is utilized as a firing transformer in a gas discharge lamp, the preferable embodiment is that the length $d_1$ and $d_2$ (see FIG. 3A) is 15.88 mm, the size of the cross section of the groove 14 is the same as the cross section of the circle with the diameter of 1 mm, the material of the core is Mn-Zn type ferrite, and the operating frequency is 40 kHz. And, the number of turns of the control winding is less than 10.

As described above in detail, according to the present invention, the productivity of a transformer is improved due to the machine winding of a control coil. Further, the structure of the core is simplified, and the assembling process of the transformer is simplified as no laminated core is utilized. Further, due to the use of a ferrite core, use at a high frequency is possible.

From the foregoing, it will now be apparent that a new and improved transformer has been found. It should be understood of course that the embodiments disclosed are merely illustrative and are not intended to limit the scope of the invention. Reference should be made to the appended claims, therefore, rather than the specification as indicating the scope of the invention.

What is claimed is:

1. A transformer comprising two E-shaped core parts, each having a back from one side of which projects at right angles thereto three spaced-apart legs, positioned with the extremities of the legs abutting such as to define a center leg and a leg at either side thereof between the backs of the E-shaped core parts, a spool on which is wound a coil positioned on the center leg and an I-shaped core part of a length and breadth corresponding to the length and breadth of the backs of the E-shaped core parts positioned in engagement with the back of one of the E-shaped core parts, means defining an open groove at the interfaces exclusively in one of said interfaces, a coil wound on the I-shaped core part, the windings of which are received in said groove and a C-shaped, elastically-engageable clamp means encompassing the core parts and clamping the E-shaped core parts in engagement with each other and the I-shaped core part in engagement with the back of said one of the E-shaped core parts.

2. A transformer according to claim 1 wherein the groove is in the face of the I-shaped core part facing the back of the E-shaped core part.

3. A transformer according to claim 1 wherein the groove is in the planar surface of the back of the E-shaped core part upon which the I-shaped core part is positioned.

4. A transformer according to claim 1 wherein there are flanges at opposite ends of the spool to one of which there is affixed a plurality of connector pins for coupling the transformer to an external circuit.

* * * * *